US005181384A

United States Patent [19]

Buchmann

[11] Patent Number: 5,181,384

[45] Date of Patent: Jan. 26, 1993

[54] ICE PARTICLE SEPARATOR

[75] Inventor: Oscar A. Buchmann, San Pedro, Calif.

[73] Assignee: Allied-Signal Inc., Morris Township, Morris County, N.J.

[21] Appl. No.: 664,898

[22] Filed: Mar. 4, 1991

[51] Int. Cl.[5] ..... F25J 5/00

[52] U.S. Cl. ..... 62/12; 62/124

[58] Field of Search ..... 62/10, 12, 532, 123, 62/124

[56] References Cited

U.S. PATENT DOCUMENTS

| | | | |
|---|---|---|---|
| 3,868,830 | 3/1975 | Fletcher et al. | 62/290 |
| 4,281,518 | 8/1981 | Muller et al. | 62/12 |
| 4,315,409 | 2/1982 | Prentice et al. | 62/63 |
| 4,317,665 | 3/1982 | Prentice | 62/63 |
| 4,615,176 | 10/1986 | Tippman | 62/62 |
| 4,732,585 | 3/1988 | Lerner | 55/90 |

*Primary Examiner*—Ronald C. Capossela

*Attorney, Agent, or Firm*—David B. Abel; James W. McFarland; Robert A. Walsh

[57] ABSTRACT

An ice particle separator for use within high flow velocity, low pressure loss, air or gas conditioning systems, to remove ice particles entrained within the conditioned gaseous flow stream. The ice particle separator includes a plurality of generally part-cylinder tubes arranged in a pattern to intercept the conditioned gaseous flow stream, each part-cylinder tube having an associated heating means for melting the ice particles which contact the part-cylinder tubes. A drain plenum collects the melt liquid from the part-cylinder tubes and directs the melt liquid to a receiving means.

18 Claims, 3 Drawing Sheets

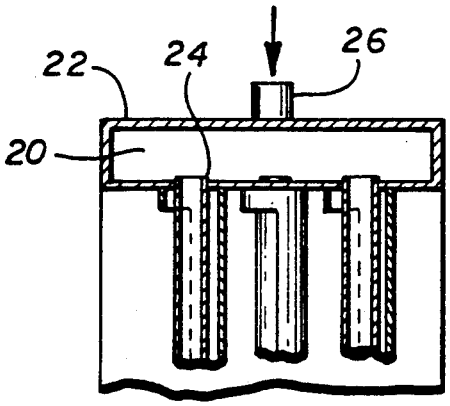
FIG. 2
FIG. 3
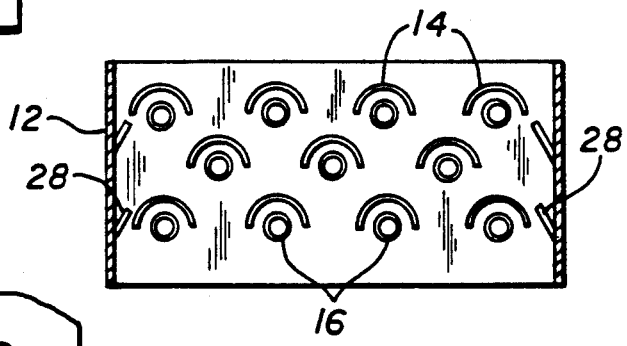
FIG. 4
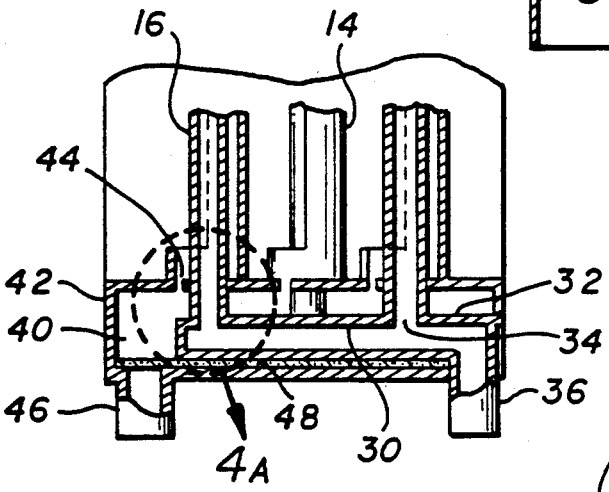
FIG. 6
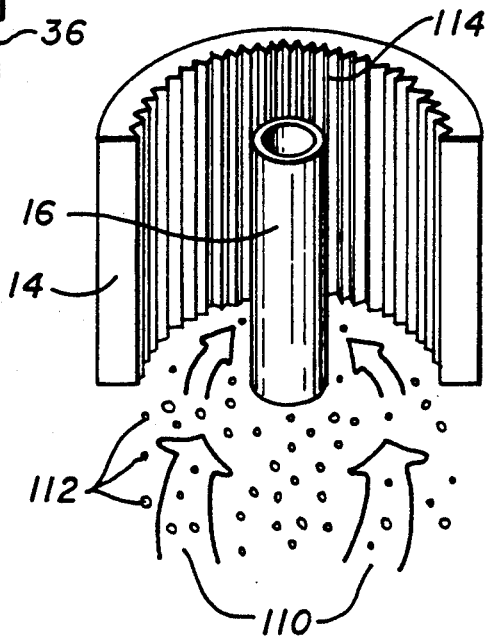
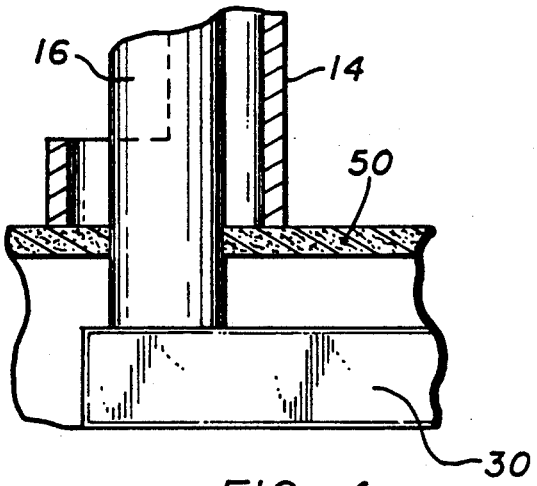
FIG. 4A

ICE PARTICLE SEPARATOR

The invention was made with Government support under Contract No. F-33657-86-C-2210, awarded by the Department of the Air Force. The Government has certain rights in this invention.

BACKGROUND OF THE INVENTION

The invention is directed to a device for extracting frozen particles from a gas flow stream. More particularly, a device for trapping, melting, and removing ice particles from a cryogenically cooled air flow stream is detailed. The device is equally useful in extracting frozen substituents from a super-cooled or cryogenic gaseous flow stream.

Certain air conditioning systems and gas conditioning and purification systems have as a requirement the extraction of substantially all moisture in various forms from a relatively high velocity flow stream of super-cooled or cryogenically cooled air or gas. One method of simultaneously cooling and removing a substantial percentage of the entrained moisture is to provide a pair of heat exchanger devices which are alternately cycled into and out of the flow stream such that one of the heat exchanger devices cools the flow stream and allows freezing of entrained moisture on the surfaces of the heat exchanger while the second heat exchanger is heated to melt the accumulated ice to form a liquid which is then removed. While this type of arrangement is generally successful for removing a large percentage of the moisture from the gas flow stream, one hundred percent removal is not practical.

When the gas flow stream is cooled to extremely low temperatures, any remaining moisture freezes into very small ice particles. In a high velocity flow stream, these small, low mass particles are extremely difficult to collect and remove. In addition, high flow stream velocities also tend to cause chunks of the ice which has frozen within the heat exchanger to break loose and enter the flow stream. These ice chunks must also be removed from the flow stream.

For applications requiring very high purity of the resulting cooled air or gas flow stream, all of the ice particles remaining downstream of the heat exchanger devices must be removed. When the applications also require high flow velocities coupled with minimum pressure loss tolerance in a compact space, particle separators of the prior art are unsatisfactory. Accordingly, a new, compact, frozen particle separator for high flow velocity, low pressure loss applications is desirable.

SUMMARY OF THE INVENTION

The present invention is directed to an ice separator device for use within high flow velocity, low pressure loss, air or gas conditioning systems, to remove ice particles entrained within the conditioned gaseous flow stream. More particularly, the ice separator includes a plurality of generally part-cylinder tubes arranged in a pattern to intercept the conditioned gaseous flow stream, each part-cylinder tube having an associated heating means for melting the ice particles which contact the part-cylinder tubes. The preferred heating means comprises a plurality of heating tubes disposed coaxially with respect to the part-cylinder tubes. A plenum at an axial end of the heating tubes distributes a flow of hot liquid to the heating tubes and a second plenum at the opposite axial ends of the heating tubes recovers the hot liquid. Ice particles contacting the concave surface of the part-cylinder tubes are melted and the resulting melt flows to the end of the part-cylinder tubes. A drain plenum collects the melt liquid from the part-cylinder tubes and directs the melt liquid to a receiving means. The part-cylinder tubes 14 may additionally include means for promoting the flow of the melt liquid to the drain plenum. A system incorporating the ice separator is also detailed.

BRIEF DESCRIPTION OF THE DRAWINGS

FIG. 2 is a partial cross sectional view of the top portion of the ice separator taken along line 2—2 of FIG. 1.

FIG. 3 is a partial cross sectional view of the ice separator taken along line 3—3 of FIG. 1.

FIG. 4 is a partial cross sectional view of the bottom portion of the ice separator taken along line 4—4 of FIG. 1.

FIG. 4A is an exploded view of an alternate arrangement for the portion of FIG. 4 identified by circle A.

FIG. 6 is an enlarged fractional view of a single part-cylinder tube 14 and associated heating tube 16.

DETAILED DESCRIPTION OF THE PREFERRED EMBODIMENT

Figure 1:
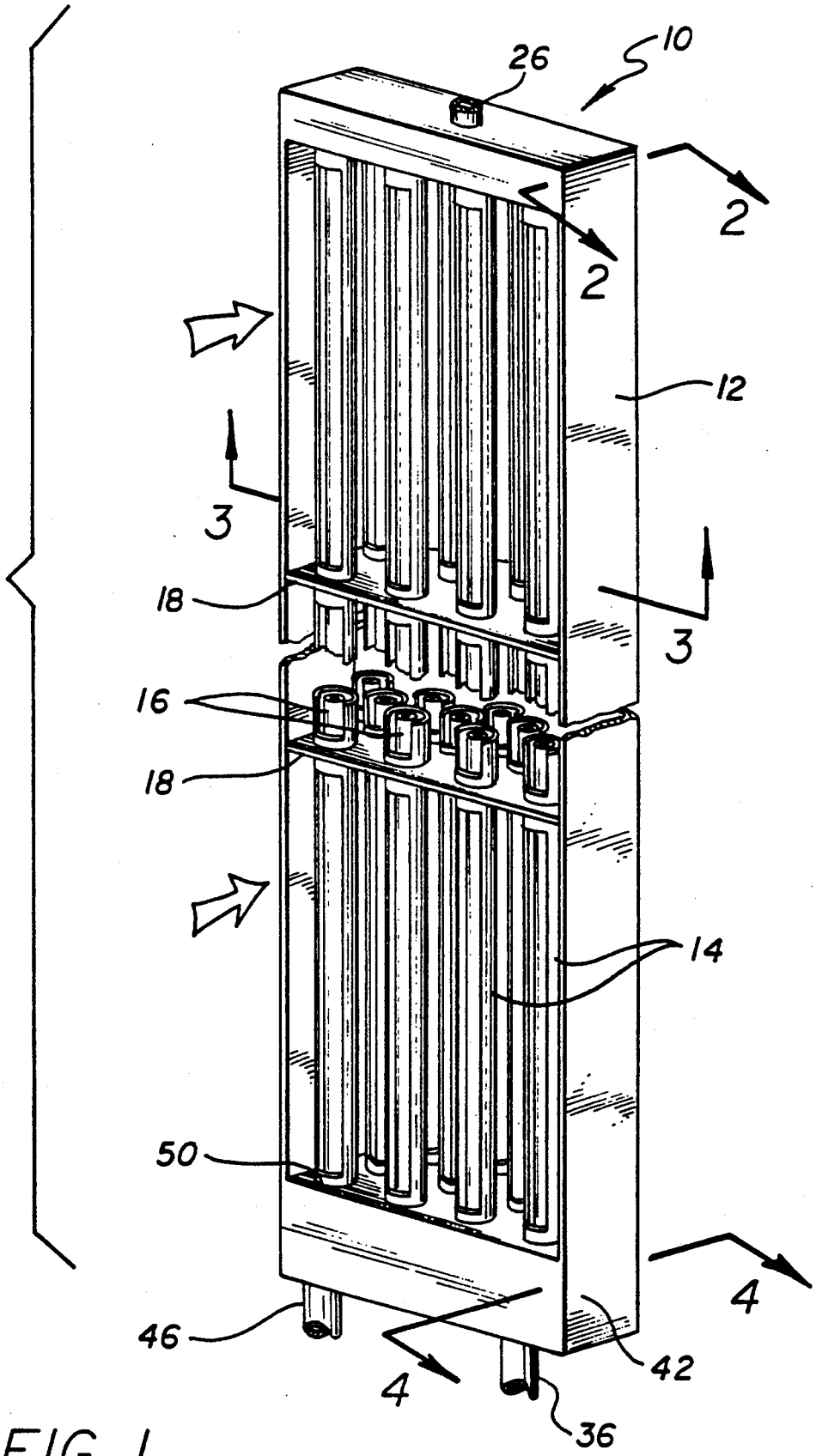
FIG. 1 depicts a perspective view of the ice separator of the present invention.

FIG. 1 depicts a perspective view of an ice separator 10 according to the present invention. The ice separator 10 includes a housing 12 which contains a means for removing entrained ice particles from a gaseous flow stream. Preferably, the means for removing ice particles comprises a plurality of generally part-cylinder tubes 14. The part-cylinder tubes 14 are arranged in an array configured to present the open, or concave face of the part-cylinder to the inlet flow side of the ice separator 10. Each part-cylinder tube 14 generally defines an arch of less than about 210 degrees, and is preferably between about 120 to 180 degrees. Furthermore, the distribution of the part-cylinder tubes 14 is staggered such that a majority of the entire cross-sectional plane of the inlet side of the ice separator 10 is faced by at least one of the part-cylinder tubes 14. By this arrangement, the plurality of part-cylinder tubes 14 act as centripetal accelerators for removing the ice particles as more fully described below.

The ice separator 10, and more specifically each of the plurality of part-cylinder tubes I, include a means for heating the part-cylinder tubes 14. Preferably, the means for heating comprises a like plurality of heating tubes 16, each of said heating tubes 16 being paired with one of said part-cylinder tubes 14. Preferably, the heating tubes 16 are coaxially aligned with the part-cylinder tubes 14.

The housing 12 of the ice separator 10 may include support plates 18 at appropriate intervals to provide structural support to the part-cylinder tubes 14 and heating tubes 16. The support plates are required when the ice separator 10 is configured to have the part-cylinder tubes 14 and heating tubes 16 extend for substantial lengths in relationship to their diameters.

FIG. 2 is partial cross-sectional view taken along line 2—2 of FIG. 1 and depicting the top portion of the ice separator 10. In FIG. 2, an inlet plenum 20 located at the top of the ice separator 10 and contained within a plenum housing 22 portion of the housing 12 is illustrated. The inlet plenum 20 communicates with the heating tubes 16 through the open ends 24 of the heating tubes 16. An inlet flow conduit 26 communicates with the inlet plenum housing 22 to deliver a flow of hot fluid to the plenum 20 and subsequently to the heating tubes 16.

FIG. 3 depicts a partial cross-sectional view of the ice separator 10 of FIG. 1 taken along line 3—3 thereof, and more particularly depicting the array of the plurality of part-cylinder tubes 14 and associated heating tubes 16. The walls of housing 12 define the flow channel passing through the ice separator 10. A plurality of tabs 28 extending inward from the walls of housing 12 serve to deflect the incoming air stream, and more importantly any ice particles carried therein, away from the walls and towards one of the part-cylinder tubes 14. As depicted in FIG. 3, the array of the part-cylinder tubes 14 presents at least one concave or open face of a part-cylinder tube 14 to a majority of the frontal area of the ice separator 10, to thereby promote contact of any ice particles contained within the gaseous flow stream with the concave surfaces of the part-cylinder tubes 14.

FIG. 4 is a partial cross-sectional view of the bottom portion of the ice separator 10 taken along line 4—4 of FIG. 1. In FIG. 4, an outlet plenum 30 defined by an outlet plenum housing 32 is configured to receive the heating fluid from the heating tubes 16 through a plurality of connecting ports or holes 34, which connect the plenum 30 with the heating tubes 16 at the lower ends thereof. The outlet plenum housing 32 is also connected to a conduit 36 which receives the heating fluid flow from the outlet plenum 30. The bottom portion of housing 12 also defines a drain plenum 40 contained within a drain plenum housing 42 portion of the housing 12. The drain plenum 40 essentially encloses the plenum housing 32 of the heating fluid circuit. In addition, the drain plenum 40 receives melt liquid flow from the part-cylinder tubes 14 through a plurality of holes 44 communicating between the drain plenum 40 and open portions at the bottom of the part-cylinder tubes 14. A drain conduit 46 attached to the drain plenum housing 42 receives the melt liquid from the drain plenum 40 and directs the melt liquid to a receiving means not shown.

Preferably, a means for separating liquid from gas such as a liquid permeable, gas impermeable porous membrane 48 is disposed within the drain plenum housing 42 interspaced between the holes 44 from the part-cylinder tubes 14 and the drain conduit 46. The porous membrane 48 is designed to act as a barrier to gases while promoting the flow of liquid therethrough, i.e., the porous membrane 48 is hydrophobic.

Alternatively, as shown in the exploded view of FIG. 4A, the drain plenum housing 42 may include a top surface 50 formed from a liquid permeable, gas impermeable porous membrane 52. The plurality of part-cylinder tubes 14 are attached to one side of the top surface 50, whereby melt liquid from the part-cylinder tubes 14 which contacts the porous membrane 52 is passed therethrough to the drain plenum 40, while gas passage through the porous membrane 52 is inhibited. By way of example, the porous membrane 48 or 52 may be a partially densified powder metal compact such as zinc, copper, or stainless steel.

Figure 5:
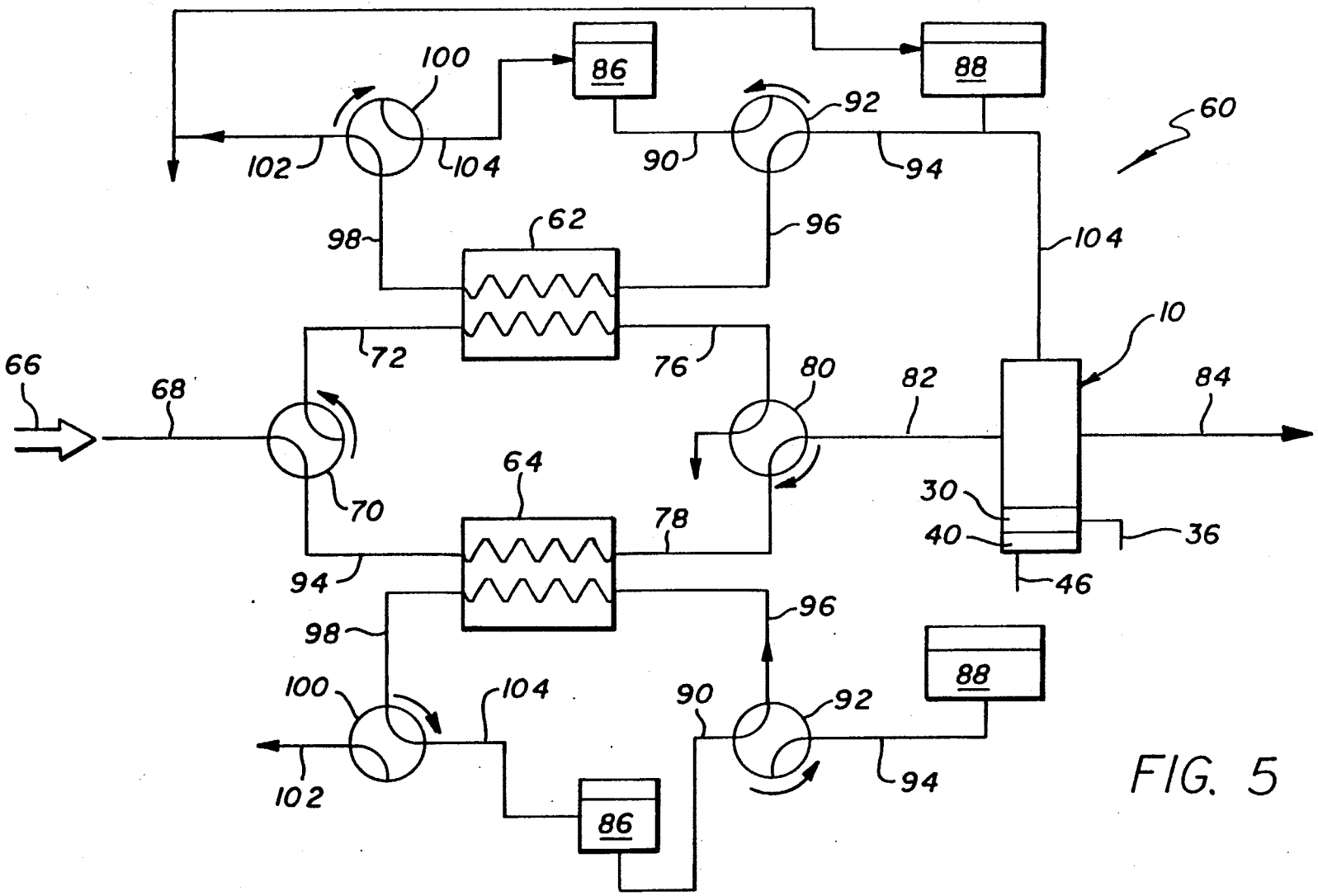
FIG. 5 is a schematic depiction of an air or gas conditioning system incorporating the ice separator of the present invention.

FIG. 5 depicts schematically an air or gas conditioning system 60 incorporating the ice separator 10 of the present invention. The conditioning system 60 further includes a first heat exchanger 62 and a second heat exchanger 64. An air or gas inlet gaseous flow stream represented by arrow 66 is directed through a conduit 68 to a valve means 70 which distributes the inlet gaseous flow stream 66 to one of the first or second heat exchangers 62, 64 via conduits 72 or 74 respectively. Downstream of first heat exchanger 62 or second heat exchanger 64, the gaseous flow stream is directed through a conduit 76 or 78 respectively to a valve 80. The valve 80 is configured to then direct the gaseous flow stream through a conduit 82 to the ice separator 10. After passing through the ice separator 10, the gaseous flow stream is conducted via conduit 84 to a receiving means not shown.

The conditioning system 60 also includes a means for producing a flow of coolant, for example a coolant source 86, as well as a means for producing a flow of heating fluid, for example a heat source 88. A coolant from the coolant source 86 is conducted via duct 90 to a valve 92, similarly a heating fluid from the heat source 88 is conducted through a duct 94 to the valve 92. Valve 92 is designed to flow connect either duct 90 or 94 with a duct 96. The duct 96 directs either the coolant or heating fluid to the heat exchanger 62, wherein the respective coolant or heating fluid passes in heat exchange relationship with the gaseous flow stream within the first heat exchanger 62. A duct 98 receives either the coolant or heating fluid from the first heat exchanger 62 and directs the coolant or heating liquid to a valve 100. The valve 100 redirects the coolant via a duct 104 to the coolant source 86 or to other uses (not shown), and additionally the valve 100 directs the heating fluid to a duct 102 which may either connect to a waste reservoir (not shown) or to the heating source 88. An analogous heating and/or cooling loop is provided for the second heat exchanger 64, having like numbers representing like elements, in the schematic of FIG. 5.

The conditioning system of FIG. 5 is designed to receive an inlet gaseous flow stream 66 which includes either humidity if the gaseous flow stream is air or an impurity substituent for a gas flow stream. The valve 70 directs the gaseous flow stream to one of either first or second heat exchanger 62, 64. For example as depicted in FIG. 5, the gaseous flow stream is directed to the second heat exchanger 64. When receiving the gaseous flow stream, the second heat exchanger 64 is also connected to receive the flow of cooling flow from the coolant source 86, whereby the gaseous flow stream is cooled and entrained humidity or moisture which contacts the surfaces of the heat exchanger flow passageways will freeze and adhere to the second heat exchanger 64. The now cooled gaseous flow stream exiting the second heat exchanger 64 is directed via conduit 78 through valve 80 and conduit 82 to the ice separator 10.

Although a majority of the humidity entrained within the gaseous flow stream upstream of the second heat exchanger 64 is removed by contacting and freezing on the surfaces of the second heat exchanger 64. The cooled gaseous flow stream exiting the second heat exchanger 64 is cooled to a temperature wherein any remaining humidity will form discrete ice particles within the cooled gaseous flow stream. These ice particles are then directed to the ice separator 10 which is disposed in the cooled gaseous flow stream and impact on the concave surfaces of the part-cylinder tubes 14 (of FIG. 1). A flow of heating fluid is directed from the heat source 88 through conduit 104 to the inlet plenum 20 of the ice separator (FIG. 2) and subsequently the heating fluid flows through the heating tubes 16 which convectively heat and melt impacting ice particles, and also radiantly heat the concave surfaces of the part-cylinder tubes 14 to a temperature such that the ice particles from the gaseous flow stream which contact the part-cylinder tubes 14 are melted and adhere to the concave surfaces of the part-cylinder tubes 14. The cooled air or gas within the cooled gaseous flow stream navigates the tortuous route through the ice separator 10, then exits the ice separator 10 and flows out through duct 84. It should be noted that while the embodiments depicted in the figures include three rows of part-cylinder tubes 14, additional rows may be used to increase the percentage of ice particles removed, or when there are a substantial number of ice particles in the gaseous flow stream.

The first heat exchanger 62 and second heat exchanger 64 are cycled such that during the time period when the second heat exchanger 64 is in flow communication with the gaseous flow stream to cool the gaseous flow stream as described above, the first heat exchanger 62 is receiving the heating fluid from heat source 88 via ducts 94, valve 92, and duct 96. The hot fluid flowing through heat exchanger 62 causes the ice which has accumulated in a previous cycle on the gaseous flow stream flow passages within the first heat exchanger 62 to melt. The melted liquid then is collected and dumped to a reservoir or to ambient (not shown). After all of the moisture which has frozen on the surfaces of the first heat exchanger 62 has been melted and removed, the valves 70, 80, 92 and 100 are switched to their alternate position to reverse the cycles with the first heat exchanger 62 and second heat exchanger 64 and the direction of the gaseous flow stream 66.

FIG. 6 illustrates how the plurality of part-cylinder tubes 14 act as centripetal accelerators for removing the ice particles. In FIG. 6, an enlarged fractional view of a single one of the part-cylinder tubes 14 and associated heating tube 16 is depicted. The gaseous flow stream, shown by arrows 110, includes entrained discrete ice particles 112. The gaseous flow stream initially approaches the part-cylinder tube 14 at a perpendicular angle to the open face thereof. As the gaseous flow encounters the part-cylinder tube 14, the flow is turned, generally following the curvature of the part-cylinder tube 14. This redirection of the gaseous flow stream causes the entrained ice particles 112, which have a comparatively greater mass, to be centripetally accelerated toward the concave surface of the part-cylinder tube 14. When the ice particles 112 contact the warm part-cylinder tube 14, the ice particles 112 adhere and melt.

The part-cylinder tubes 14 may additionally include means for promoting the flow of the melt liquid to the drain plenum 40 (of FIG. 4) such as a plurality of very small axially aligned grooves 114 to promote wicking of the melt liquid. The part-cylinder tubes 14 may further be oriented at a slight angle with respect to the gaseous flow stream 110 such that the pressure force of the gaseous flow stream tends to aid the flow of the melt liquid toward the base of the part-cylinder tubes 14 and the drain plenum 40.

It should be evident from the foregoing description that the present invention provides many advantages over the prior art. Although preferred embodiments are specifically illustrated and described herein, it will be appreciated that many modifications and variations of the present invention are possible in light of the teaching to those skilled in the art. It is preferred, therefore, that the present invention be limited not by the specific disclosure herein, but only by the appended claims.

I claim:

1. An ice particle separator to extract entrained ice particles from a gaseous flow stream, comprising:

a housing;

a plurality of generally part-cylinder tubes contained in said housing and arranged in an array configured to present a concave face of said part-cylinder tubes to an inlet flow side of said ice particle separator;

means for heating said plurality of part-cylinder tubes to a temperature to cause ice particles contacting said plurality of part-cylinder tubes to melt to a liquid; and means for promoting extraction of said liquid from said gaseous flow stream.

2. The ice particle separator of claim 1, wherein said means for heating said part-cylinder tubes comprises a like plurality of heating tubes, each of said heating tubes being paired with one of said part-cylinder tubes.

3. The ice particle separator of claim 2, wherein said heating tubes are coaxially aligned with said part-cylinder tubes.

4. The ice particle separator of claim 2, wherein said ice particle separator further comprises:

an inlet plenum located at the top of said ice particle separator and contained within a plenum housing portion of said housing, said inlet plenum communicating with said heating tubes through open ends of said heating tubes; and means for delivering a flow of hot fluid to said inlet plenum and said heating tubes.

5. The ice particle separator of claim 4, wherein said ice particle separator further comprises:

an outlet plenum housing of said housing defining an outlet plenum, said outlet plenum configured to receive said heating fluid from said heating tubes through a plurality of connecting holes at the ends thereof; and means for receiving said heating fluid flow from said outlet plenum.

6. The ice particle separator of claim 5, wherein said ice particle separator further comprises:

a drain plenum contained within a drain plenum housing portion of said housing, said drain plenum receiving said melt liquid from said part-cylinder tubes through a plurality of holes communicating between said drain plenum and the bottom of said part-cylinder tubes; and means attached to said drain plenum housing for receiving said melt liquid from said drain plenum.

7. The ice particle separator of claim 6, wherein said drain plenum housing encloses said outlet plenum housing.

8. The ice particle separator of claim 6, wherein said ice particle separator further comprises:

means for separating said melt liquid from said gaseous medium, said means for separating disposed in said drain plenum housing.

9. The ice particle separator of claim 8, wherein said means for separating said melt liquid from said gaseous medium comprises a porous membrane interspaced between said plurality of part-cylinder tubes and said means attached to said drain plenum housing for receiving said melt liquid from said drain plenum, porous membrane selected to act as a barrier to gases while promoting the flow of liquid therethrough.

10. The ice particle separator of claim 9, wherein said porous membrane is a partially densified powder metal compact selected from the group consisting of zinc, copper, and stainless steel.

11. The ice particle separator of claim 5, wherein said ice particle separator further comprises:

a drain plenum housing portion of said housing defining a drain plenum, said drain plenum housing including a liquid permeable-gas impermeable surface attached to the ends of said plurality of part-cylinder tubes, said liquid permeable-gas impermeable surface allowing the passage therethrough of said melt liquid between said part-cylinder tubes and said drain plenum; and means attached to said drain plenum housing for receiving said melt liquid from said drain plenum.

12. The ice particle separator of claim 11, wherein said liquid permeable-gas impermeable surface comprises a partially densified powder metal compact selected from the group consisting of zinc, copper, and stainless steel.

13. The ice particle separator of claim 1, wherein the distribution of said part-cylinder tubes in said array is staggered such that a substantial majority of the entire cross-sectional plane of said inlet side of said ice particle separator is faced by at least one of said part-cylinder tubes.

14. The ice particle separator of claim 1 wherein said plurality of generally part-cylinder tubes include a plurality of very small axially aligned grooves on the concave surface of said part-cylinder tubes to promote wicking of the melt liquid toward the base of said part-cylinder tubes.

15. The ice particle separator of claim 1 wherein said plurality of generally part-cylinder tubes are oriented at a slight angle with respect to said gaseous flow stream such that the pressure force of said gaseous flow stream tends to aid the flow of said melt liquid toward the base of said part-cylinder tubes.

16. A gaseous fluid conditioning system to provide a flow of supercooled, high purity air or gas comprising:

a first heat exchanger;

a second heat exchanger;

first flow conducting means for distributing a gaseous flow stream to one of said first or second heat exchangers;

ice particle separator means for extracting entrained ice particles from said gaseous flow stream, said ice particle separator means including a plurality of centripetal accelerators to capture entrained ice particles and heaters for each of said plurality of centripetal accelerators to heat said centripetal accelerators to a temperature sufficient to cause ice particles contacting said plurality of centripetal accelerators to melt to a liquid, and a means for promoting extraction of said liquid from said gaseous flow stream;

second flow conducting means, downstream of said first and second heat exchangers, for directing said gaseous flow stream from said first or second heat exchangers to said ice particle separator means;

means for producing a flow of coolant;

means for producing a flow of heating fluid;

fluid flow control means for flow connecting said coolant from said means for producing a flow of coolant to said first or second heat exchangers which is receiving said gaseous flow stream from said first flow conducting means to cool said gaseous flow stream, and for flow connecting said heating fluid from said means for producing a flow of heating fluid to the other of said first and second heat exchangers which is not receiving said gaseous fluid flow from said first flow conducting means to melt accumulated ice therein to a liquid; and means for removing said melt liquid from said first or second heat exchanger.

17. The gaseous fluid conditioning system of claim 16 wherein said plurality of centripetal accelerators comprise a plurality of generally part-cylinder tubes arranged in an array configured to present a concave face of said part-cylinder tubes to an inlet flow side of said ice particle separator.

18. The gaseous fluid conditioning system of claim 17, wherein said heaters for said plurality of centripetal accelerators comprise a like plurality of heating tubes, each of said heating tubes being paired with one of said part-cylinder tubes of said centripetal accelerators.

* * * * *